US005908189A

United States Patent [19]

Flores et al.

[11] Patent Number: 5,908,189

[45] Date of Patent: Jun. 1, 1999

[54] PAPER STACK HEIGHT CONTROL

[75] Inventors: Armando Villareal Flores; Darin Michael Gettelfinger; Edward Alan Rush; Scott Stephen Williams, all of Lexington, Ky.

[73] Assignee: Lexmark International, Inc., Lexington, Ky.

[21] Appl. No.: 08/845,224

[22] Filed: Apr. 21, 1997

[51] Int. Cl.[6] ..... B65H 1/22

[52] U.S. Cl. ..... 271/164; 271/162; 221/186

[58] Field of Search ..... 271/42, 117, 118, 271/145, 162, 164, 241; 312/183; 221/186, 187; 211/50

[56] References Cited

U.S. PATENT DOCUMENTS

| | | | |
|---|---|---|---|
| 3,025,051 | 3/1962 | David et al. | 271/4 |
| 3,260,402 | 7/1966 | Lareau et al. | 221/186 |
| 3,883,132 | 5/1975 | Swanson | 271/110 |
| 3,976,291 | 8/1976 | Bernardi et al. | 271/94 |
| 4,458,890 | 7/1984 | Kawazu | 271/37 |
| 4,488,718 | 12/1984 | Tamura | 271/162 |
| 4,773,638 | 9/1988 | Koutoudis et al. | 271/171 |
| 4,780,740 | 10/1988 | Fukae | 271/171 |
| 5,026,042 | 6/1991 | Miller | 271/119 |
| 5,029,838 | 7/1991 | Kunihiro | 271/119 |
| 5,052,673 | 10/1991 | Tokuda et al. | 271/22 |
| 5,090,677 | 2/1992 | Yamakoshi et al. | 271/117 |
| 5,145,164 | 9/1992 | Kan | 271/170 |
| 5,238,238 | 8/1993 | Shinohara et al. | 271/171 |

FOREIGN PATENT DOCUMENTS

| | | | |
|---|---|---|---|
| 0 655 349 A1 | 5/1995 | European Pat. Off. | B42F 7/14 |
| 2 726 221 A1 | 5/1996 | France | B41J 13/16 |
| 2923797 A1 | 12/1980 | Germany | 271/145 |
| 359167425 | 9/1984 | Japan | 271/145 |
| 0163222 | 6/1990 | Japan | 271/162 |
| 406072578 | 3/1994 | Japan | 271/162 |
| 406144599 | 5/1994 | Japan | 271/162 |
| 406191659 | 7/1994 | Japan | 271/162 |

*Primary Examiner*—H. Grant Skaggs
*Attorney, Agent, or Firm*—John A. Brady

[57] ABSTRACT

Height barriers (15*a*, 15*b*) on the bottom of the feed arm frame (5) are located a distance above the bottom of paper drawer (1) of a printer (13). the drawer is pulled out to load paper, and then pushed in. If the paper stack (25) is high enough to encounter the barriers, paper which encounters the barrier is pushed off the top of the stack as the drawer moves further. The pushed paper emerges in front of the printer and is removed by the operator. Back restraint (17) is integral to the elevated region (17*b*) followed by an inclined region (17*a*). Overloading of paper is prevented and the paper stack not uncompressed during subsequent paper feed.

8 Claims, 5 Drawing Sheets

PAPER STACK HEIGHT CONTROL

TECHNICAL FIELD

This invention relates to apparatus to load paper in an imaging device such as a printer or copier. This invention prevents excess paper from being loaded.

BACKGROUND OF THE INVENTION

The paper pick mechanism of the kind shown in U.S. Pat. No. 5,527,026 to Padget et al. employs a drive roller on a pivoted arm and excess paper height is unacceptable as the device requires at least a predetermined downward angle of the arm for reliable functioning. When the stack is too high, drive rollers tend to slip on the top sheet rather than move it. Accordingly, the paper stack height must be controlled.

Additionally, the preferred implementation of the paper tray employs a sloped, smooth surface, termed a dam, as the initial surface against which the paper is moved by the drive rollers. The dam-style paper tray is essentially a box into which the paper or other media is dropped. There is no physical element, such as the commonly used buckling ledge (termed a corner buckler), under which the media must be positioned.

With the absence of a corner buckler, no physical stack limiter is present in the paper tray itself. Typically, a label is placed on the side of the tray to show maximum stack height, and the user must voluntarily comply with the indication on the label. Accordingly, filling the tray above the defined point is easy and might frequently occur, which would contribute to paper feed failures.

DISCLOSURE OF THE INVENTION

This invention successfully prevents tray overloading in a dam-style paper tray. It does so without compression of the paper stack which might be an added source of feed failure.

In accordance with this invention a height barrier is located above the drawer of the paper tray. The drawer is pulled out to load paper, and then pushed into the paper tray. If the media stack in the drawer is high enough to encounter the barrier, media which encounters the barrier is pushed off of the top of the media stack as the drawer is further moved into the tray. The pushed media will emerge at the front of the drawer. The operator will remove that paper intuitively as it must be removed to complete insertion of the drawer.

To assure that the media is not pressed by the height barrier during the next paper feed, the drawer has an elevated bottom region near its side opposite the front or dam side. The height barrier encounters the paper stack initially where it is elevated by being on the elevated region. As the drawer moves further, the elevated region moves past the height barrier. This leaves an empty space under the height barrier and the top of the stack, thereby assuring the barrier does not press the stack when paper is fed. In the specific embodiment, a movable back paper restraint is integral with an elevated region and then an inclined region.

BRIEF DESCRIPTION OF THE DRAWING

The details of this invention will be described in connection with the accompanying drawing, in which FIG. I illustrates a paper tray drawer and the feed and barrier elements of the paper tray from the right side, showing one shingling barrier.

BEST MODE FOR CARRYING OUT THE INVENTION

Figure 1:
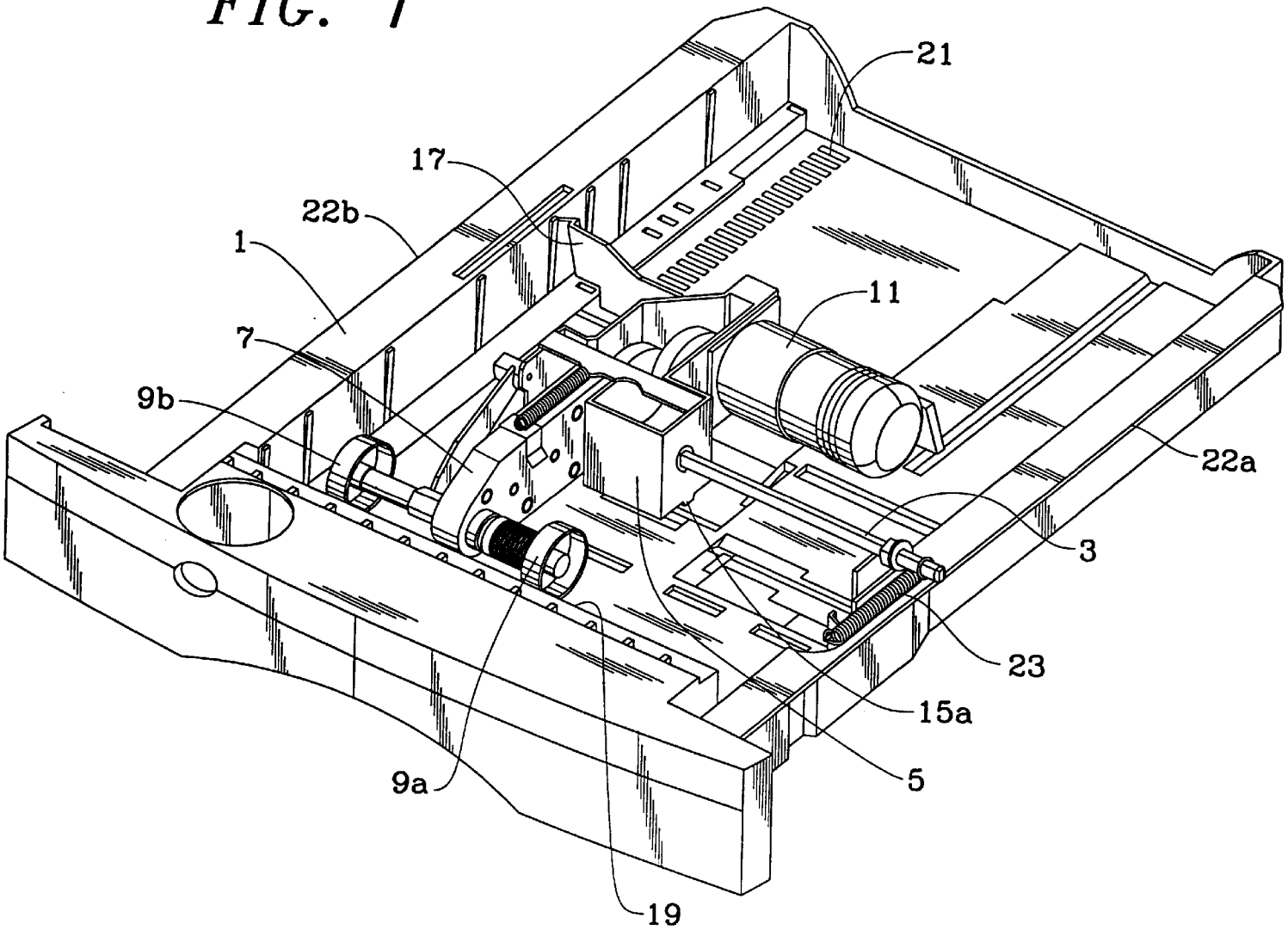

FIG. 1 illustrates a paper tray drawer 1, which is pulled out to load paper into drawer 1. Fixedly suspended on shaft 3 over the location of drawer 1 is a stationary support frame 5 and a pivoted drive arm 7, which drives rollers 9*a* and 9*b* which rest on the top of paper in drawer 1. Such driving of paper from a pivoted arm is described in the foregoing U.S. Pat. No. 5,527,026 and forms no part of this invention.

Figure 4:
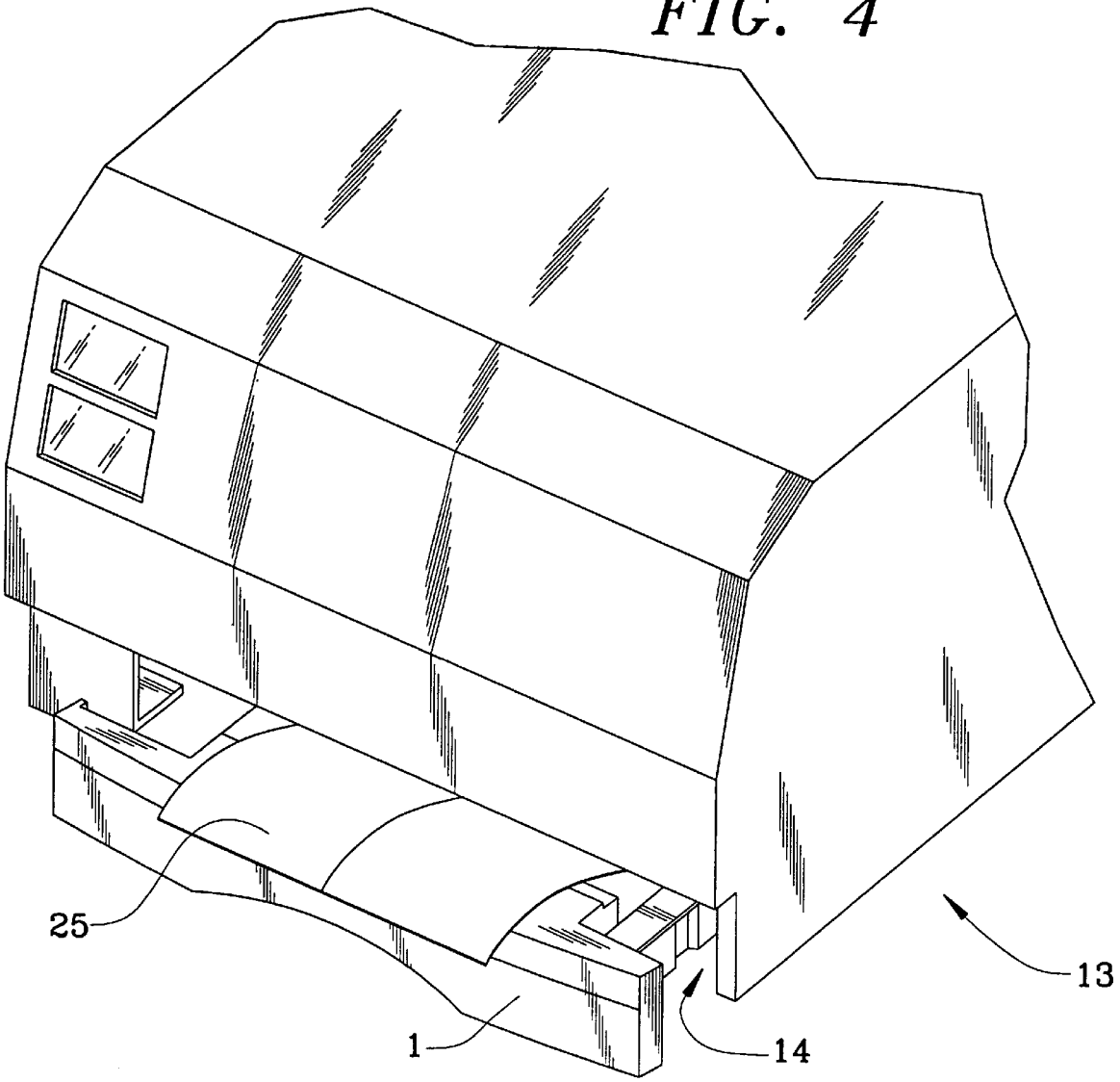
FIG. 4 shows excess paper to be removed by an operator of the imaging apparatus.

Power to the drive arm 7 is supplied by an electric motor 11 which is also supported on frame 5. The frame 5 is permanently supported as part of a paper tray for a printer 13 (FIG. 4). Drawer 1 moves relative to the frame 5 in a receptacle 14 formed by an opening in printer 13.

On the bottom right of frame 5 is a downwardly extending tooth 15*a.* Tooth 15*a* encounters and shingles paper as will be described.

An adjustable rear barrier or restraint 17 is moved manually to a position corresponding the length of paper or other media stacked in drawer 1 between the front dam 19 and restraint 17. Barrier 17 is held in each position by entering one of a series of detent ridges 21, as is conventional.

Ledges 22*a,* 22*b* on opposite sides of drawer 1 enter slots (not shown) in receptacle 14 which support drawer 1 horizontally as it is moved in and out of receptacle 14. Until drawer 1 is almost fully inserted, coil spring 23 acting on shaft 3 rotates arm 7 upward so that drive rollers 9*a,* 9*b* do not encounter paper.

Figure 2:
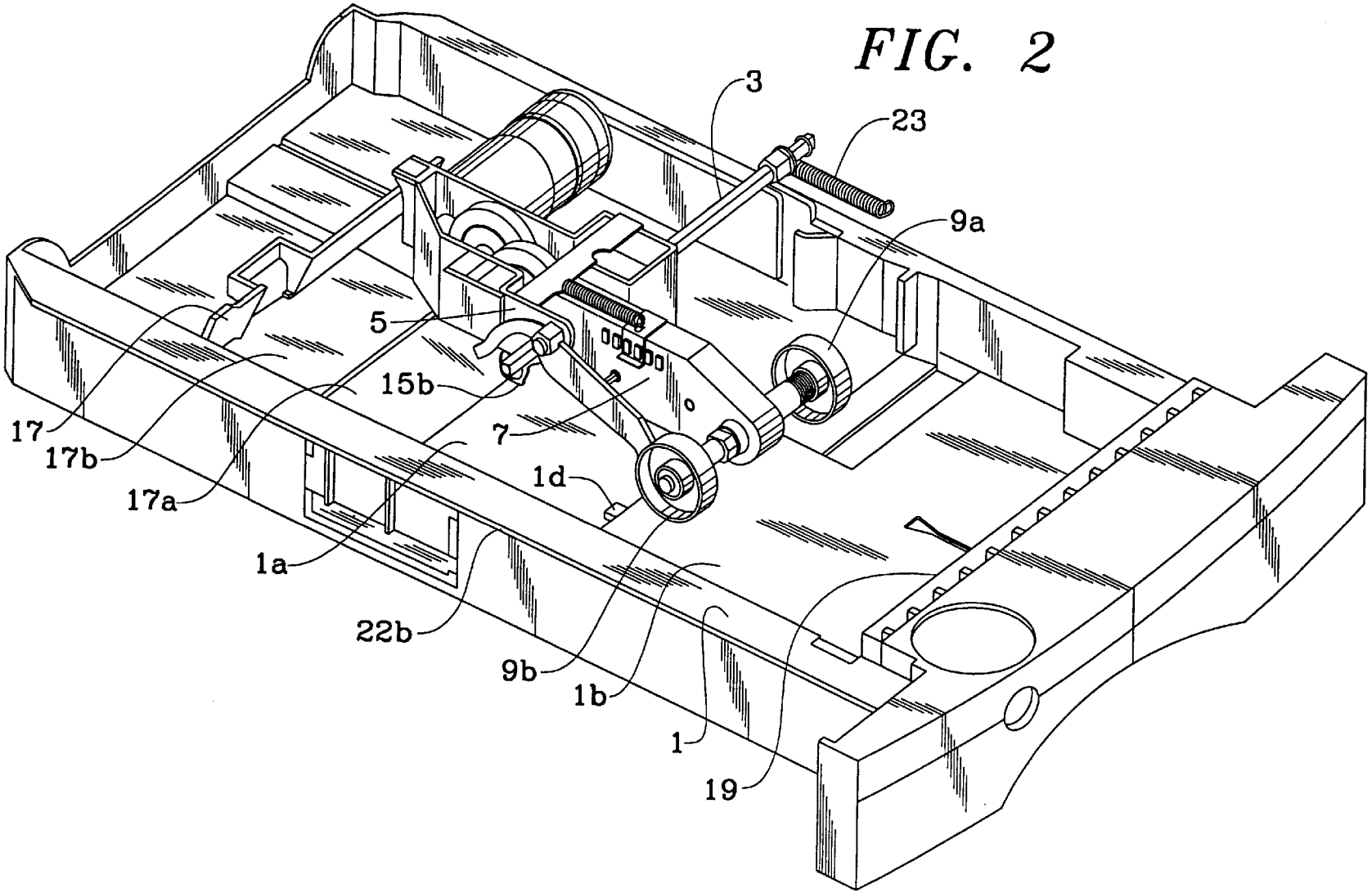
FIG. 2 is a similar view from the left side, showing the second shingling barrier.

FIG. 2 shows a similar view from the left. A second shingling barrier 15*b,* also part of frame 5, is located opposite barrier 15*a* and at the same height with respect to drawer 1. Also shown in FIG. 2 is an upward inclined region 17*a,* which is integral with rear restraint 17, and a flat region 17*b,* which is integral with restraint 17 and inclined region 17*a.* Region 17*b* is therefore higher than the region 1*a* immediately forward of inclined region 17*a.* Rear barrier 17 is adjustable to location toward an away from the front of dam 1 until incline 17*a* encounters a permanent barrier 1*d.*

Region 1*a* is not significantly wider than restraint 17. The region 1*b,* which is forward and on the side of region 1*a* is flat and somewhat higher than the region 1*a,* which is also flat. Paper in drawer 1 is supported by the higher flat region 1*b* rather than smaller, lower region 1*a.*

Figure 3A:
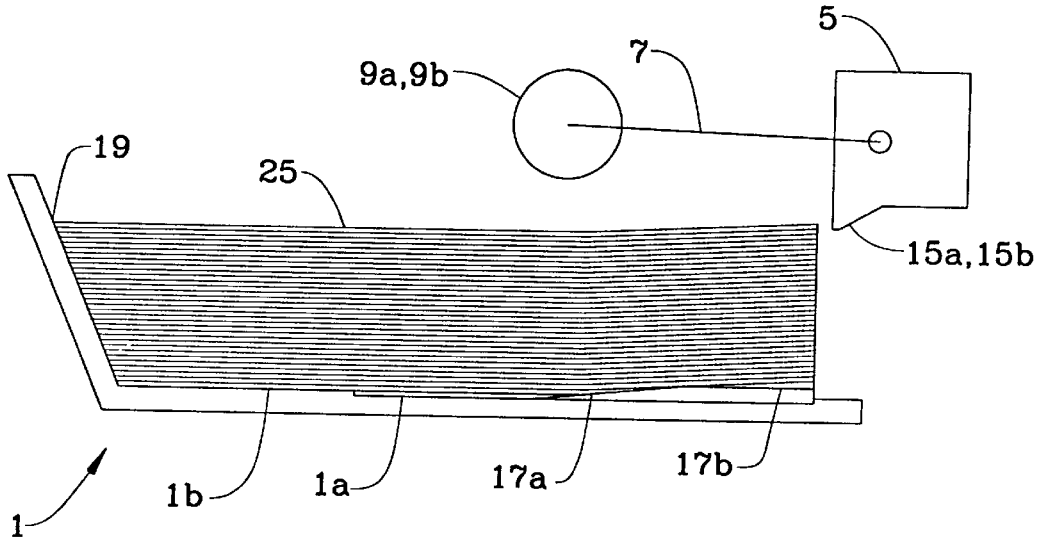
FIG. 3*a,* FIG. 3*b* and FIG. 3*c* are stylized drawings showing a sequence of operation.

In use, drawer 1 is pulled out and a stack of paper or other media 25 placed in drawer 1. FIG. 3*a* shows this status before drawer 1 is pushed back to its final position.

Figure 3B:
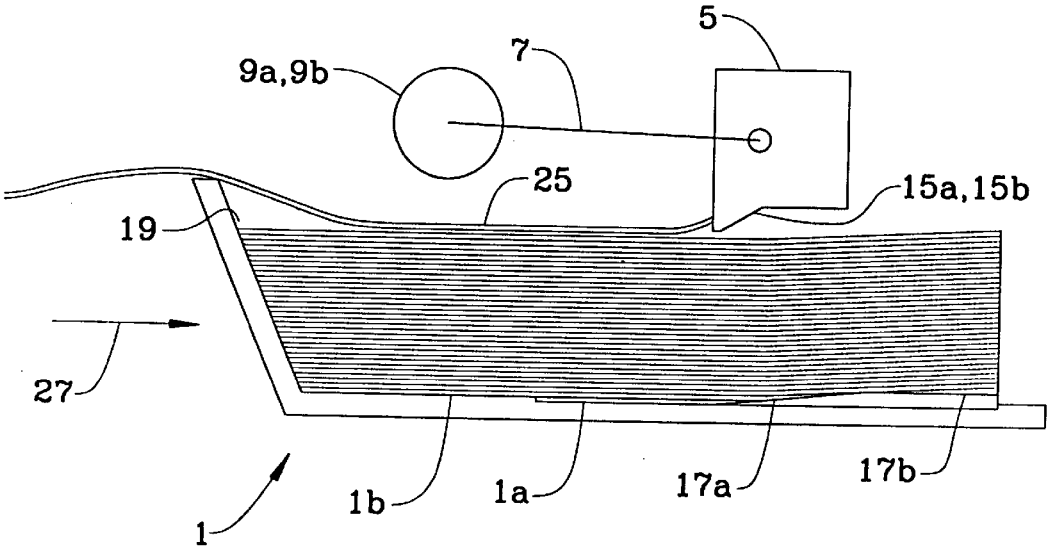

FIG. 3*b* shows the status after the printer has been pushed toward its final position in the direction shown by arrow 27. With reference to FIG. 3*a,* as drawer 1 is moved in the direction of arrow 27 (FIG. 3*b*), the shingling barriers 15*a,* 15*b* will strike the trailing edge of media 25 which exceeds a predetermined stack height of media 25. As the tray is further moved to its final position, as shown in FIG. 3*b,* the shingling barriers 15*a,* 15*b* have forced excess media over dam 19 and out of the front of drawer 1.

FIG. 4 shows the outside of a printer 13 generally in the status of FIG. 3*b* with drawer 1 partially inserted. The operator will pull away the excess paper 25, and that will be intuitive as the excess paper 25 is obviously being rejected and it prevents fill insertion of drawer 1.

Figure 3C:
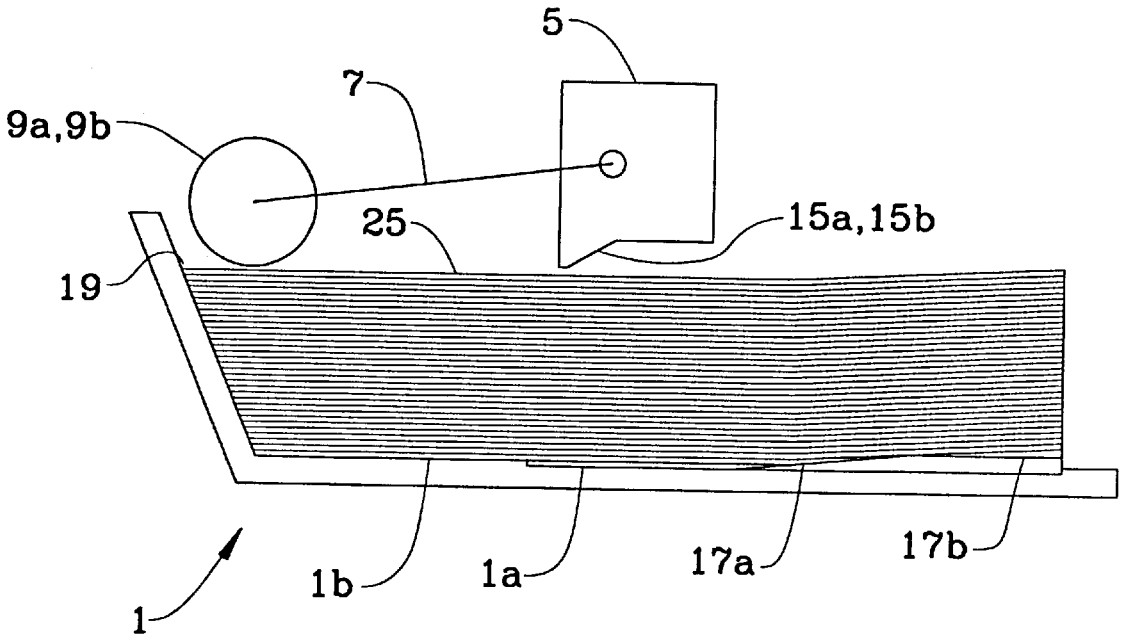

Drawer 1 is then inserted to its final position, as shown in FIG. 3*c.* Arm 7 is rotated to its active position by a camming action of drawer 1 about its final ¼ inch of insertion of drawer 1 and is therefore shown in its down position. Shingling barrier 15*a,* 15*b* are over the lower region la and therefore are not pushing down on the stack of media 25.

With the drawer 1 so located in its final position without excess stack height of media 25 and without the media 25 being pinched by barriers 15*a,* 15*b,* the paper feed mechanism comprising arm 7 will reliably feed the top sheet of media 25 from the stack in drawer 1.

As an alternative to the lower-level bottom of drawer 1, the drawer 1 could enter a drop area after partial insertion. The drawer 1 would be inserted as described and come in contact with shingling barriers 15*a,* 15*b* sufficient to pass excess media 25 out as described before drawer 1 enters the drop area. Upon subsequent movement of drawer 1 to the final position, drawer 1 would enter a lower support member that would allow a gap to exist between the shingling barrier 15*a,* 15*b* and the media 25.

It will be apparent also that the drawer 1 need not be part of a paper tray which is fixedly integrated into printer 13 as shown in FIG. 4. Instead one or more paper trays can be attached to printer 13 as accessories as by stacking them under printer 13.

Other alternatives will be apparent or can be anticipated. We claim:

1. A media height limiting apparatus comprising:

a drawer, for holding a stack of media to be fed from said drawer a receptacle in which said drawer may be inserted, and at least one barrier fixedly suspended above said drawer where said drawer is inserted within said receptacle located to encounter media stacked in said drawer above a predetermined height.

2. The media height limiting apparatus as in claim 1 in which said drawer has a smooth inclined exit dam surface on the side toward which said barrier moves encountered media.

3. The media height limiting apparatus as in claim 2 in which the regions of said drawer under said media in said drawer are higher under where said barrier initially encounters said media than under where said barrier is located upon final insertion of said drawer.

4. The media height limiting apparatus as in claim 3 also comprising an inclined region between said region under where said barrier initially encounters said media and said region under where said barrier is located upon final insertion of said drawer.

5. The media height limiting apparatus as in claim 4 also comprising a rear paper restraint in said drawer movable within said drawer, said region under where said barrier initially encounters said media and said inclined region being integral with said rear paper restraint.

6. The media height limiting apparatus as in claim 1 in which regions of said drawer under said media in said drawer are higher under where said barrier initially encounters said media than under where said barrier is located upon final insertion of said drawer.

7. The media height limiting apparatus as in claim 6 also comprising an inclined region between said region under where said barrier initially encounters said media and said region under where said barrier is located upon final insertion of said drawer.

8. The media height limiting apparatus as in claim 7 also comprising a rear paper restraint in said drawer movable within said drawer, said region under where said barrier initially encounters said media and said inclined region being integral with said rear paper restraint.

* * * * *